US010273110B2

(12) United States Patent
Thompson et al.

(10) Patent No.: US 10,273,110 B2
(45) Date of Patent: Apr. 30, 2019

(54) REUSABLE DEVICE WITH CUTTING SURFACE ENABLING STRAIGHT CUTS OF MATERIAL

(71) Applicants: Shaw Osceola Mikel Thompson, Templeton, CA (US); Francis L. Bridgeman, Atascadero, CA (US)

(72) Inventors: Shaw Osceola Mikel Thompson, Templeton, CA (US); Francis L. Bridgeman, Atascadero, CA (US)

(73) Assignee: Francis L. Bridgeman, Atascadero, CA (US)

( * ) Notice: Subject to any disclaimer, the term of this patent is extended or adjusted under 35 U.S.C. 154(b) by 149 days.

(21) Appl. No.: 14/670,343

(22) Filed: Mar. 26, 2015

(65) Prior Publication Data

US 2015/0273715 A1 Oct. 1, 2015

Related U.S. Application Data

(60) Provisional application No. 61/971,423, filed on Mar. 27, 2014.

(51) Int. Cl.

| | |
|---|---|
| ***B26D 7/00*** | (2006.01) |
| ***B65H 35/00*** | (2006.01) |
| *B05B 12/24* | (2018.01) |

(52) U.S. Cl.

CPC ..... *B65H 35/0026* (2013.01); *B05B 12/24* (2018.02); *Y10T 83/04* (2015.04); *Y10T 83/8878* (2015.04)

(58) Field of Classification Search

CPC ..... B65H 36/0026; B65H 35/002; B65H 35/0086; B65H 2701/1752; B65H 35/0033; B65H 35/004; B05B 15/0456; Y10T 83/04

See application file for complete search history.

(56) References Cited

U.S. PATENT DOCUMENTS

| | | | | |
|---|---|---|---|---|
| 2,324,028 A * | 7/1943 | Rossi | ..... | A47K 10/3827 225/42 |
| 2,850,157 A * | 9/1958 | Klein | ..... | B65D 83/0841 225/42 |
| 5,307,717 A | 5/1994 | Winston | | |
| 5,322,201 A * | 6/1994 | Garr | ..... | B65H 35/002 225/20 |

(Continued)

*Primary Examiner* — Kenneth E Peterson
*Assistant Examiner* — Liang Dong
(74) *Attorney, Agent, or Firm* — Zilka-Kotab, P.C.

(57) ABSTRACT

A device according to one embodiment includes a sidewall defining an interior; at least one cutting channel having, and/or configured to receive, at least one cutting strip; an opening in the sidewall configured to allow a sheet of material to pass therethrough from the interior; a door coupled to the sidewall; and a handle coupled to the sidewall. A device according to another embodiment includes a peripheral sidewall; a lid coupled to an upper edge of the peripheral sidewall, the lid and the peripheral sidewall defining an interior; a bottom edge of the peripheral sidewall defining an opening to the interior, the interior being configured to receive a sheet of material; at least one cutting channel having, and/or configured to receive, at least one cutting strip; and an opening in the lid, the opening being configured to allow the sheet of material to pass therethrough from the interior.

8 Claims, 7 Drawing Sheets

(56) References Cited

U.S. PATENT DOCUMENTS

| | | | | |
|---|---|---|---|---|
| 5,611,255 | A * | 3/1997 | Evans | B23D 35/008 83/614 |
| 5,819,935 | A * | 10/1998 | Lawson | B65H 35/0006 206/408 |
| 6,105,481 | A | 8/2000 | Schuler | |
| 6,966,473 | B1 | 11/2005 | Hayden | |
| 7,406,904 | B2 | 8/2008 | Antal et al. | |
| 7,424,843 | B2 * | 9/2008 | Guillory | B26D 1/045 225/39 |
| 7,603,937 | B2 | 10/2009 | Pavlik et al. | |
| 2005/0035133 | A1 | 2/2005 | Gerulski et al. | |
| 2006/0065611 | A1 * | 3/2006 | Blateri | B65H 16/005 211/55 |
| 2010/0072243 | A1 * | 3/2010 | Pelton | B65H 35/002 225/49 |
| 2010/0288904 | A1 | 11/2010 | Wang et al. | |
| 2011/0209594 | A1 | 9/2011 | Withers | |

* cited by examiner

REUSABLE DEVICE WITH CUTTING SURFACE ENABLING STRAIGHT CUTS OF MATERIAL

RELATED APPLICATION

The present application claims benefit of U.S. Provisional Patent Application No. 61/971,423 filed Mar. 27, 2014, which is incorporated by reference.

FIELD OF THE INVENTION

The present invention relates to a reusable device, and more particularly, this invention relates to a reusable device having one or more cutting surfaces for making straight cuts of a material.

BACKGROUND

Plastic is commonly used by painters, e.g., for masking and/or covering items to protect them from coming into contact with wet paint. However, the plastic used by painters (also referred to herein as painter's plastic) is sold in large quantities (e.g., rolls) that are housed in boxes that frequently fall apart before the entirety of the large quantity of plastic can be used. The majority of boxes in which the painter's plastic is sold are made from cardboard or similar materials. Thus, exposure to liquids (e.g., rain, puddles, paint, etc.) can cause deterioration of the box. As a result, the painter's plastic is exposed and as a result becomes unraveled and/or damaged.

Moreover, because painter's plastic is sold in large quantities, pieces of different sizes are cut off the roll to fulfil a particular use. For example, a 10 foot long piece of painter's plastic may be cut off the roll to cover an object having a length of 8 feet, while a 5 foot long piece of painter's plastic may be cut off the roll to cover an object having a length of 2 feet.

Further still, the painter's plastic is folded over on itself multiple times. Thus cuts made to the painter's plastic that are not straight, e.g., crooked, jagged, etc., are amplified when the folded material is unfolded. This is particularly undesirable when using the painter's plastic for masking.

Conventional boxes housing the material serve as poor cutting surfaces. After only a few cuts using a surface of a conventional box as a cutting surface, the box becomes structurally degraded. As a result, the rate of deterioration for the box is increased and the box quickly becomes an unviable cutting surface as well. It is nearly impossible to achieve straight cuts in painter's plastic using conventional products.

In sharp contrast, various embodiments described herein include a device that has a durable cutting surface for making straight cuts in a material. Furthermore, different devices describe below desirably introduce a reusable housing for the material that may also serve as a carrying case, as will be described in further detail below.

SUMMARY

A device according to one embodiment includes a sidewall defining an interior; at least one cutting channel having, and/or configured to receive, at least one cutting strip; an opening in the sidewall configured to allow a sheet of material to pass therethrough from the interior; a door coupled to the sidewall; and a handle coupled to the sidewall.

A device according to another embodiment includes a peripheral sidewall; a lid coupled to an upper edge of the peripheral sidewall, the lid and the peripheral sidewall defining an interior; a bottom edge of the peripheral sidewall defining an opening to the interior, the interior being configured to receive a sheet of material; at least one cutting channel having, and/or configured to receive, at least one cutting strip; and an opening in the lid, the opening being configured to allow the sheet of material to pass therethrough from the interior.

Other aspects and advantages of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

DETAILED DESCRIPTION

Figure 1A:
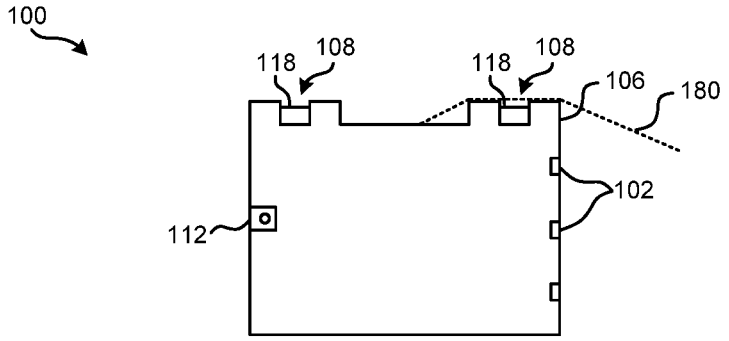
FIG. 1A-1C are side views of a device, in accordance with one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified. It should also be noted that, as used herein, the term "about" with reference to some stated value refers to the stated value ±50% of said value. Further, while illustrative values are presented throughout, this is done by way of example only and without limitation. Accordingly, any modification, alteration, or equivalent of the various embodiments described herein, as would be appreciated by one having ordinary skill in the art upon reading the descriptions, should also be considered within the scope of this disclosure.

As mentioned above, painter's plastic is conventionally sold in large quantities (e.g., rolls) that are housed in boxes that frequently fall apart before the entirety of the large quantity of plastic can be used. The majority of boxes in which the painter's plastic is sold are made from cardboard or similar materials. Thus, exposure to liquids (e.g., rain, puddles, paint, etc.) can cause deterioration of the box. As a result, the painter's plastic is exposed and as a result becomes unraveled and/or damaged.

Furthermore, these conventional boxes housing the material serve as poor cutting surfaces. After only a few cuts using a surface of a conventional box as a cutting surface, the box becomes structurally degraded. As a result, the rate of deterioration for the box is increased and the box quickly becomes an unviable cutting surface in addition to an unsuitable housing for the roll of material therein.

In sharp contrast, the following description discloses several preferred embodiments of a reusable device and/or related systems and methods. As previously mentioned, the reusable device preferably has at least the ability to make significantly straight cuts of a material via cutting surfaces. Moreover, other embodiments herein may further incorporate additional features including, but not limited to, replaceable sacrificial cutting surfaces and/or handles for carrying the device, as will soon become apparent.

Looking to FIGS. 1A-1G, a device 100 is illustrated in accordance with one embodiment. As an option, the present device 100 may be implemented in conjunction with features from any other embodiment listed herein, such as those described with reference to the other FIGS. Of course, however, such device 100 and others presented herein may be used in various applications and/or in permutations which may or may not be specifically described in the illustrative embodiments listed herein. Further, the device 100 presented herein may be used in any desired environment.

Figure 1B:
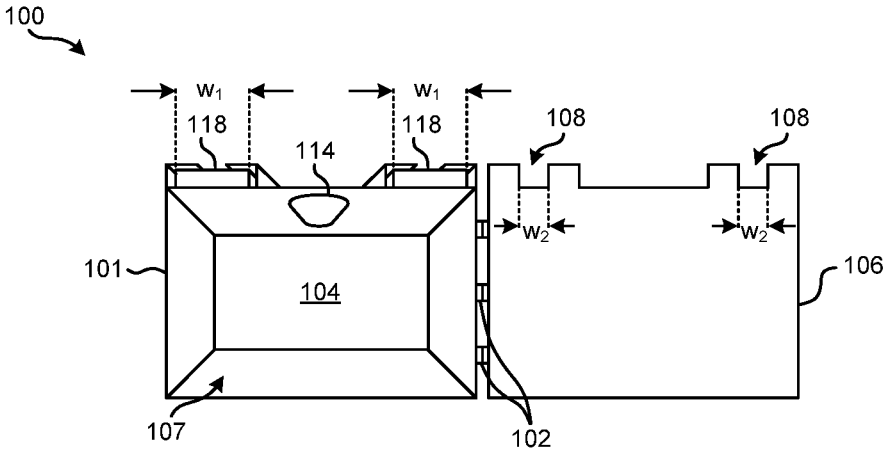
Figure 1C:
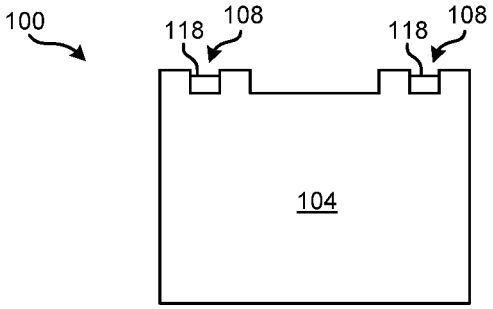

FIGS. 1A-1C present a side views of the device 100 from different ends thereof. As shown, the device 100 includes a sidewall 101 (used interchangeably herein with a main body 101), an opening 114 extending through a surface of the main body 101, a door 106 having recessed portions 108, at least one cutting channel 110 having and/or configured to receive at least one cutting strip 118, and a handle 116 coupled to the main body 101. Recessed portions 108 may additionally be located at a side 104 of the device 100 opposite the side of the device 100 having the door 106, e.g., see FIGS. 1C and 1F. Accordingly, at least one end of each of the cutting channels 110 preferably has a recessed portion 108, e.g., for preventing damage to the device and/or external cutting device when making a cut, as will be described in further detail below.

Referring specifically to FIG. 1A, a side view of the device 100 is shown from the door side of the device 100 with the door 106 closed. As described above, when the door 106 is in a closed position, the door 106 preferably secures the cutting strips. For embodiments incorporating removable cutting strips, it is greatly preferred that the door be closed when a cut is being made with an external cutting device, so the cutting strips 118 remain stationary.

FIG. 1A further illustrates hinges 102 and latch 112 which may include any of the approaches described herein.

Preferably the main body 101 is constructed of a substance strong enough to withstand external forces exerted on the device 100 when cutting a material as will soon become apparent. Moreover, it is desirable that the main body 101 is constructed of a substance capable of protecting material (e.g., painter's plastic) housed therein from external contaminants. Illustrative substances for the main body 101 and/or any other part of device 100 may include plastic, nylon, wood, metal, rubber, etc., or any other substance which would be apparent to one skilled in the art upon reading the present description.

According to different embodiments, the main body 101 may be formed using different processes. For example, if the main body of the device is made using metal, the main body may be constructed using bending, stamping, bar breaking, spot welding, etc. According to another example, if the main body of the device is made using wood, the main body may be constructed using screws, adhesives, fasteners, etc.

The door 106 is coupled to the main body 101 and opens allowing access to an interior area 107 defined by a main body 101. In other words, the inside surface of the main body 101 of the device 100 defines the interior 107. In preferred approaches, the door 106 may be coupled to the main body 101 of the device 100 via one or more hinges 102 of a type known in the art. Thus, the door 106 may be swung between open and closed positions as seen in FIGS. 1A and 1B respectively. However, in other approaches, the door 106 may be completely removable from the corresponding side of the device. As will be described in further detail below, fastening components (e.g., see latch 112) may be released, thereby allowing the door 106 to be completely removed from the corresponding side of the device 100.

Looking now to FIG. 1B, a side profile of the device 100 is shown with door 106 in an open position. As previously described, when the door 106 is in an open position, the cutting strips 118 and/or product, e.g., holding a roll of painter's plastic (not shown), may be removed and/or inserted. Moreover, when a product is inserted into the interior area 107 inside the main body 101, it is preferred that the product be inserted enough such that it is positioned against an opposite side 104 of the device 100.

However, in some instances, a product being inserted into the interior 107 may be dimensionally smaller than the spatial dimensions of the interior 107 itself, e.g., may have a shorter length that that of the interior 107. In other words, although the product may be fully inserted into the interior area 107, once the door 106 is closed, the product may not be long enough to come into contact with opposite ends of the device 100. This is undesirable as when the device 100 is transported and/or used, the product may shift in the interior area 107 of the main body 101 of the device 100, thereby making it difficult for a user to access a roll of material held in the product. Therefore, spacers may be implemented in some embodiments.

The interior area 107 of the main body 101 of the device 100 may be configured to receive a spacer. A spacer (not shown) may be positioned on one or both ends of the interior area 107 of the main body 101 of the device 100, thereby effectively shortening the length of the interior 107. As a result, although a product being inserted may be dimensionally smaller than the interior 107, the spacers reduce the spatial dimensions of the interior area 107 and provide a more desirable fit for the product. Moreover, the spacers preferably center the product along the length of the device, e.g., such that a sheet of material protruding from the product is about aligned with at the opening 114.

In further approaches, the spacers may be reversible. According to the present description, "reversible" is intended to mean that the one or more spacers may be positioned in the interior area 107 with a first orientation that results in effectively shortening the length of the area as described immediately above. However, the spacers may be positioned in a second orientation that is shifted from the first orientation about 180°. When in a second orientation, an open end of the spacer may receive an end of a product having larger dimensions than a product which may be received by the interior 107 having the spacers be positioned in the first orientation. Thus, the spacers may fit over the ends of a product having larger spatial dimensions when in a second orientation during normal use, and the spacers may also be flipped to a first orientation when receiving a product having smaller dimensions (e.g., length) than a length of the interior 107.

Figure 1D:
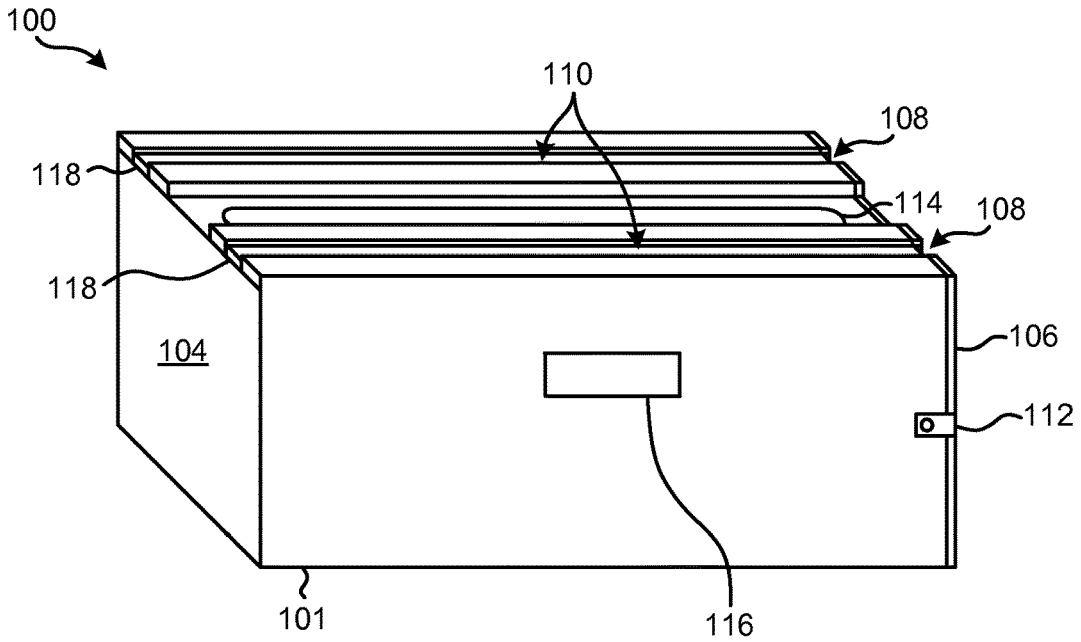
FIG. 1D is a partial perspective view of the device of FIGS. 1A-1C.

FIG. 1C shows the side 104 of the device 100 opposite that of the door as seen in FIG. 1B. This side 104 is preferably a solid panel that the cutting strips 118 butt-up against. Furthermore, FIGS. 1D and 1F illustrate perspective views of the device 100 from different angles. As illustrated, the device 100 includes cutting channels 110 having, and/or configured to receive, at least one cutting strip 118, latch 112 which is preferably coupleable to a buckle (not shown) as described above, hinges 102, cutting channel 110 and handle 116.

Figure 1E:
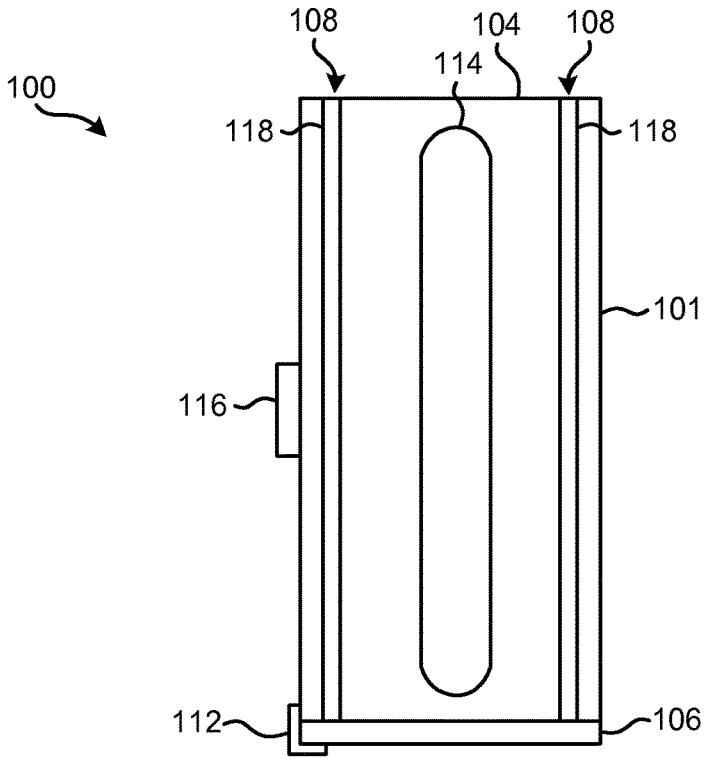
FIG. 1E is a top down view of the device of FIGS. 1A-1C.
Figure 1F:
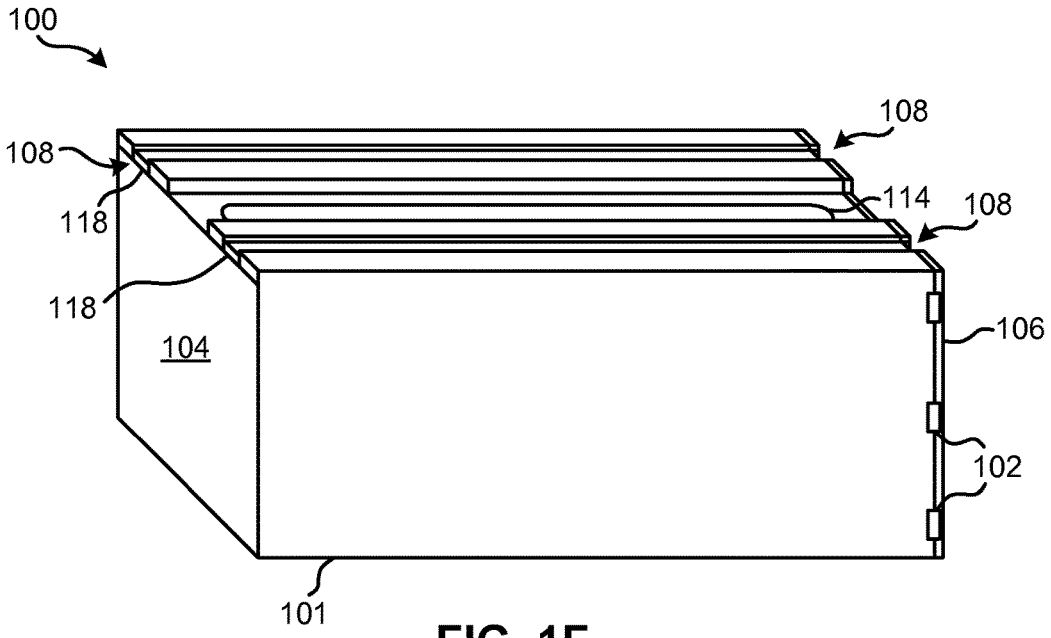
FIG. 1F is a partial perspective view of the device of FIGS. 1A-1C.

FIG. 1E depicts a top down view of the device 100 with the door 106 secured in a closed position via latch 112. Moreover, the device 100 includes channels 110 for receiving the cutting strips 118, handle 116 and opening 114.

Figure 1G:
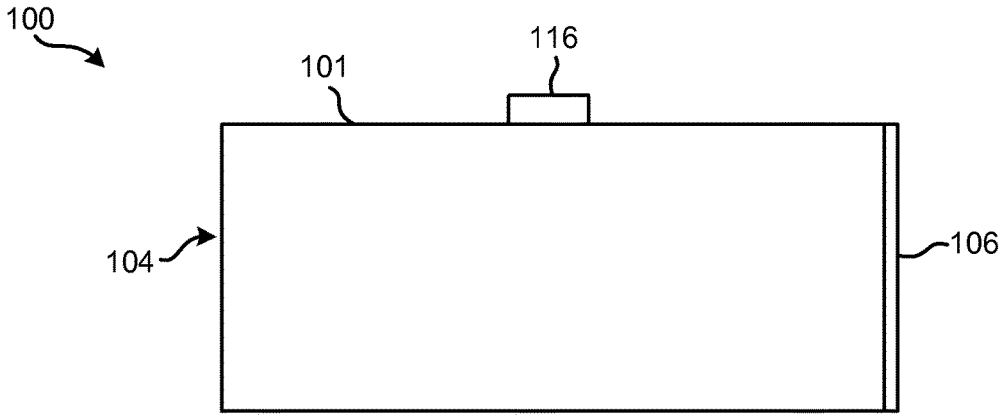
FIG. 1G is a bottom up view of the device of FIGS. 1A-1C.

Furthermore, FIG. 1G illustrates a bottom view of the device 100 having handle 116 and door 106 in the closed position.

According to the in use embodiment illustrated in FIGS. 1A-1G, a product, e.g., a box holding a roll of painter's plastic, may be inserted into or removed from the interior area 107 once the door 106 has been opened, e.g., as seen in FIG. 1B. It follows that the main body 101 is preferably large enough to have a desired product fully inserted into the interior area 107 defined by the main body 101. Moreover, once the product is fully inserted into the area, the door 106 may preferably be closed such that an interior surface of the door 106 rests flush against an end of the product. The exemplary embodiment in FIGS. 1A-1F of U.S. Provisional Patent Application No. 61/971,423, which has been incorporated by reference, illustrates a process of inserting a product into the device and cutting a desired amount of material extracted from the product using cutting surfaces formed by cutting strips positioned in the cutting channels. FIG. 1A illustrates a sheet of material 180 extending from the opening (see 114 of FIGS. 1B, 1D, 1E) to a cutting channel 108, which is positioned relative to the opening 114 to receive the sheet of material 180 directly over the cutting channel 108 in a stretched flat form.

Referring still to FIGS. 1A-1G, although the present embodiment is illustrated as having a door 106 that opens on a particular side of the main body 101, in other embodiments, a door may be incorporated with any side of the device 100. For example, in one embodiment, a top face of the device 100 having the opening 114 and channels 110 therein, may have a door incorporated therewith. Thus, to access the interior area 107 defined by the main body 101 of the device 100, the top face may be lifted, e.g., upon being released from a latch, as will soon become apparent. Moreover, such top-loaded devices may be more desirable from a production standpoint in some embodiments.

Although it is not readily apparent when looking at the different views of device 100 in FIGS. 1A-1G, the door 106 includes a latch 112 attached thereto that is coupleable to a buckle fastened to the main body 101 of the device 100. Thus the door 106 may be secured in a closed position by being coupled to a buckle via the latch 112 (e.g., see FIGS. 1A and 1D-1E). However, in other approaches, the latch 112 may be attached to the main body 101 while a buckle is attached to the door 106. In yet further approaches, a first buckle may be attached to the door 106 while a second buckle is attached to the main body 101 and the latch 112 may be coupleable to both of the first and second buckles.

In to various embodiments the latch 112 and a buckle may include any coupleable pair of objects. In one example, the latch 112 may include a loop of string permanently attached to the door 106, while the buckle includes a hook permanently attached to the main body 101 for receiving the loop of string. In another example, the latch 112 may include a piece of flexible material having one end permanently attached to the door 106 and a free end attached to one piece of a snap fastener, while the buckle includes the second piece of a snap fastener that is permanently attached to the main body 101.

Referring momentarily to FIGS. 1D-1E, the handle 116 may include any object that may create a hand hold for a user, e.g., when moving the device 100. Thus, the handle 116 may include a piece of rope, a shaped piece of metal, a block of material, etc. Moreover, the handle 116 is preferably permanently coupled to the main body 101 of the device 100, e.g., using fasteners, adhesive(s), rivets, etc. Although the embodiment illustrated in FIGS. 1A-1G includes one handle 116, according to other embodiments, a second handle, third handle, fourth handle, etc. may be added on any one or more of the surfaces of the main body 101.

According to alternative embodiments, one or more slots may be incorporated in the side of the main body 101, e.g., to function as a handle. Depending on the desired embodiment, one slot large enough to receive a user's hand, several slots large enough to receive a user's fingers, etc. may be added on any one or more of the surfaces of the main body 101.

Opening 114 extending through a surface of the main body 101 is preferably large enough (dimensionally) to allow for a sheet of material to pass therethrough from the interior 107. It follows that the shape and size of the opening 114 may vary depending on the desired embodiment. Moreover, the edges of the main body 101 forming the opening 114 are preferably patterned such that they form a non-abrasive edge which prevents causing damage to a material when being pulled through the opening 114 from the interior area 107. Depending on the substance of the main body 101, the edges of the main body 101 forming the opening 114 may be sanded, bent, rounded, etc. to form a non-abrasive edge. Again, the exemplary embodiment in FIGS. 1A-1F of U.S. Provisional Patent Application No. 61/971,423, which has been incorporated by reference, illustrates a process of inserting a product into the device and cutting a desired amount of material extracted from the product using cutting surfaces formed by cutting strips positioned in the cutting channels.

Cutting strips 118 are positioned in the cutting channels 110, thereby forming cutting surfaces on portions of the cutting strips 118 that are exposed in the cutting channels 110. In some approaches, the cutting strips 118 may be permanently positioned in the channels 110, e.g., using adhesive(s), fasteners, etc. However in other approaches, the cutting strips 118 may slide into the channels such that they may be replaced after a certain amount of use. Thus in some embodiments, the channels 110 are able to receive removable cutting strips 118 that may therefore be replaced when desired. As illustrated, according to one approach the channels 110 may use a replaceable rail system that allow for the cutting strips 118 to be slid in or out of the channels 110 when desired.

The cross-sectional profiles of the channels 110 may vary to fit cutting strips 118 of different sizes and/or shapes, depending on the desired embodiment. According to exemplary embodiments, the channels 110 may have a cross-sectional profile that fits a standard paint mixing stick serving as a cutting strip 118. Such embodiments may be advantageous as paint mixing sticks are cheap and readily available, thereby resulting in minimum upkeep costs of the cutting device during use.

In other embodiments, the cutting strips 118 may include a sacrificial material which may include, but is in no way limited to, Teflon, plastic, nylon, wood, metals (e.g., cold-rolled steel), etc., or any other material which would be apparent to one skilled in the art for making a cutting surface upon reading the present description. According to some embodiments, the substance used to form the cutting strips 118 may determine whether they are stationary or replaceable as described above.

As mentioned above, a product having a roll of material may be received (e.g., inserted into) the interior 107 of the device 100. Moreover, a sheet of material may be pulled from the interior 107 and through the opening 114. Once a desired length of the sheet of material has been pulled through the opening 114, the material may be stretched flat over one of the channels 110, whereby the corresponding cutting surface may be used to cut the material using an external cutting device, e.g., any object having a sharp edge suitable for cutting.

As described above, the material (e.g., painter's plastic) may be folded over on itself multiple times in some embodiment. The act of cutting sheets of materials which have been folded over upon themselves multiple times quickly dulls the cutting edge (sharpness) of the cutting device used to cut the material. As a result, it may be undesirable for some of the devices described herein to incorporate an integrated cutting device. Accordingly, device 100 may not include an external cutting device, thereby omitting the use of cutting tools that are integrated with device 100. In other words, device 100 may include the proviso that no one or more integrated cutting devices are coupled to the device 100. If integrated cutting tools were implemented, they would become stuck and bind due to the multiple layers of material being cut through. Furthermore, cutting certain types of material can quickly dull a blade, which would render an integrated cutting device, and ultimately the device as a whole, useless.

Rather, as previously mentioned, an external cutting device is preferably used to cut the material at the cutting surface. As would be appreciated by one skilled in the art, the cutting edge of the external cutting device may be pressed against the cutting surface and run along the length of the channel 110, thereby forming a separation (cut) between two portions of the material. The channel 110 desirably guides the external cutting device, thereby producing a substantially straight cut of the material. As a result, the cut section of material may desirably have straight edges. Straight edges are particularly desired when using the cut section of material for masking as any jagged edges are amplified when the folded material is unfolded.

Referring again to FIGS. 1A-1G, as a portion of material is cut by an external cutting device in one of the channels 110, the motion of the external cutting device may cause the external cutting device to be carried past the end of the material and reach an end of the cutting strip 118, e.g., due to user error, momentum, etc. However, the recessed portions 108 of the door 106, and opposite side 104 of the device 100, allow for the external cutting device to move past the end of the cutting strips 118 and off an end of the device 100 altogether without damaging the door 106 and/or opposite side 104. Furthermore, by implementing recessed portions 108, a user may be able to achieve a smooth cut from beginning to end in either direction along the cutting surface.

It follows that, without such recessed portions 108 of the door 106, if the external cutting device were to be drug to the end of the cutting strip 118, the external cutting device would come into contact with the door 106 when closed and positioned flush against the end of the device (as described above), thereby causing damage to the door 106, external cutting device and/or user, e.g., depending on the material of the door, type of external cutting device being used, etc.

Furthermore, the recessed portions 108 of the door 106 are also preferably shaped to retain the cutting strips 118 when the door is secured in a closed position. Looking to FIGS. 1A-1B, it is apparent that a width $w_1$ of the cutting strips 118 are wider than a width $w_2$ of the recessed portions 108. Additionally or alternatively, a height of the recessed portions 108 may be less than a height of the cutting strips 118. As a result, the cutting strips 118 are desirably held in the channels 110 and are prevented from sliding out an end of the device having the door 106, e.g., during transport of the device, while cutting a portion of material, etc., if the door 106 is secured in a closed position. Illustrative depths of the recessed portions 108, from a top surface of the door, may be from about 0.15 inches to about 0.5 inches, but may be higher or lower depending on the desired embodiment. However, it should be noted that in some approaches, the door 106 of a device may not have recessed portions, e.g., for top-loaded devices as described above.

Additional embodiments may further include a retractable hanger. The retractable hanger may be extended, folded, etc., to a hanging position to hang the device from a ledge, hook, hole, pole, etc. off the ground. This desirably allows for the device to be supported off the ground, thereby allowing for easier access to a user, prevention of damage and contamination to the device and/or the material stored therein, etc.

The retractable hanger is preferably positioned towards the side of the device having the slot, e.g., the top, such that while the device is hanging from the hanger, the material may still be accessed and/or cut along the cutting surfaces.

Figure 3A:
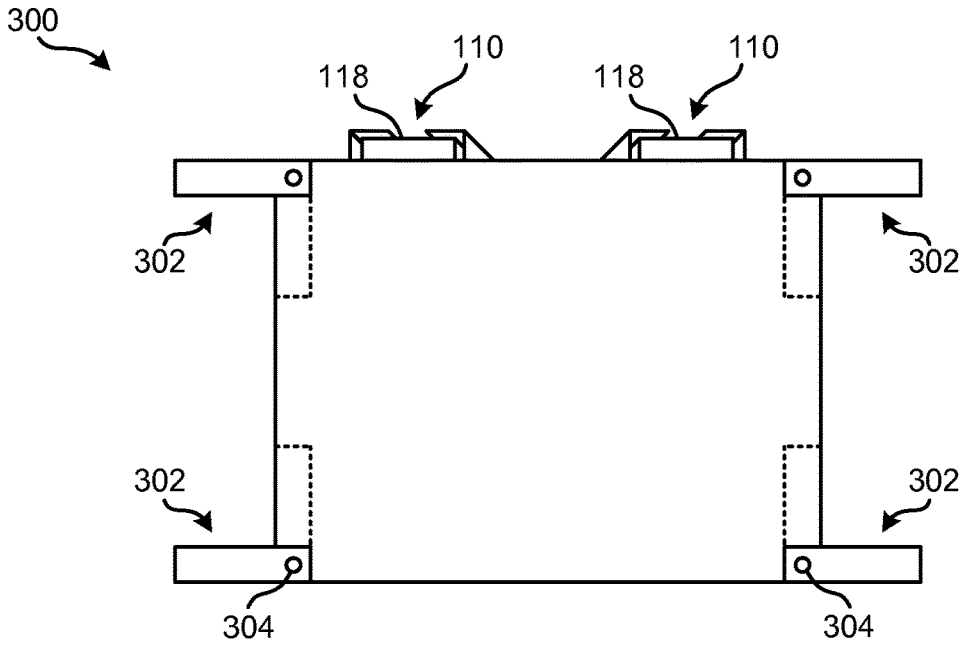
FIG. 3A is an end view of a device, in accordance with one embodiment.
Figure 3B:
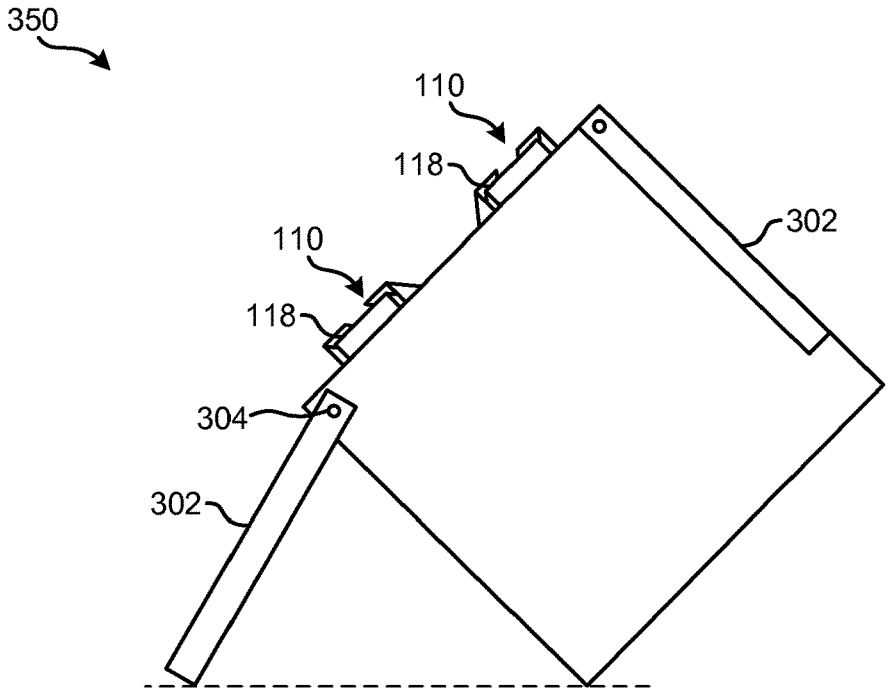
FIG. 3B is an end view of a device, in accordance with one embodiment.

Additionally or alternatively, a retractable hanger 302 may function as a fold-out leg 302 to stabilize and/or angle the device when on the ground (e.g., see FIG. 3B). Thus, in some embodiments, the device may have a hanger, e.g., for hanging the device, and/or fold-out legs, e.g., for stabilization of the device when positioned on the ground, coupled to a sidewall of the device. As the roll of material stored in the device gets smaller as more material is used, the roll becomes lighter and therefore does not have enough weight to hold down the device (prevent the device from tipping over) when pulling material therefrom. In other words, after a certain amount of the roll has been used, the weight of the roll is no longer sufficient to overcome tangential forces produced by pulling the material from the device, thereby causing the device to topple to its side which is undesirable. However, the fold-out legs may prevent this tipping and/or toppling from happening. The fold-out legs and/or retractable hanger may be coupled to a sidewall of the device using any conventional method, e.g., using a hinge, a fastener, etc.

In yet further approaches, fold-out legs may additionally or alternatively support the device such that a bottom surface of the device is suspended above the ground, e.g., to prevent damage and contamination to the device and/or the material stored therein. Illustrative embodiments of devices 300, 350 having fold-out legs 302 coupled thereto using pivotable joints 304 are shown in FIGS. 3A-3B, respectively, which are presented by way of example and are in no way intended to limit the invention. Moreover, FIGS. 3A-3B may be incorporated with any of the other embodiments described herein. Accordingly, various components of FIGS. 3A-3B have common numbering with those of FIGS. 1A-1G.

Figure 2A:
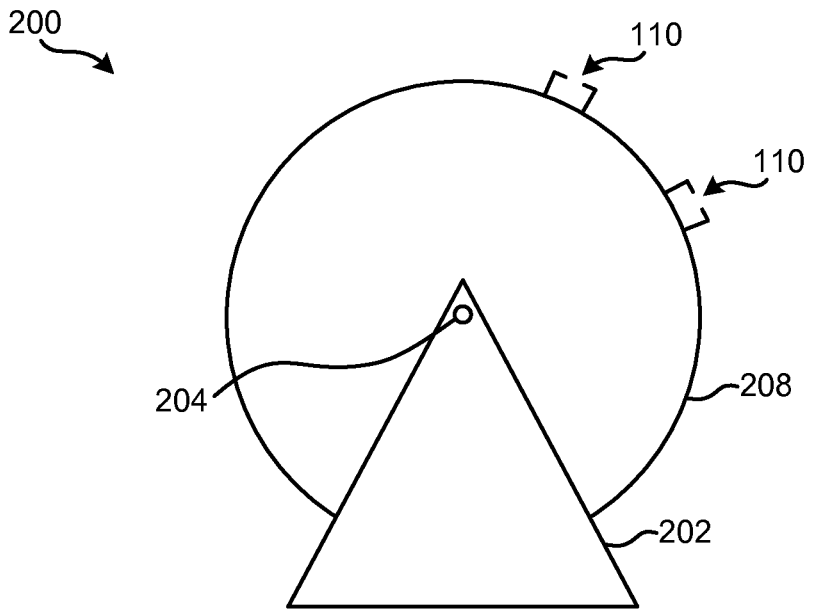
FIG. 2A is an end view of a device, in accordance with one embodiment.

Although FIGS. 1A-1G illustrate devices having a rectangular side profile, in other embodiments a device may have a side profile that is circular, triangular, etc., depending on the desired embodiment. For example, looking to FIG. 2A, a device 200 includes a main body 208 having a circular side profile.

Figure 2B:
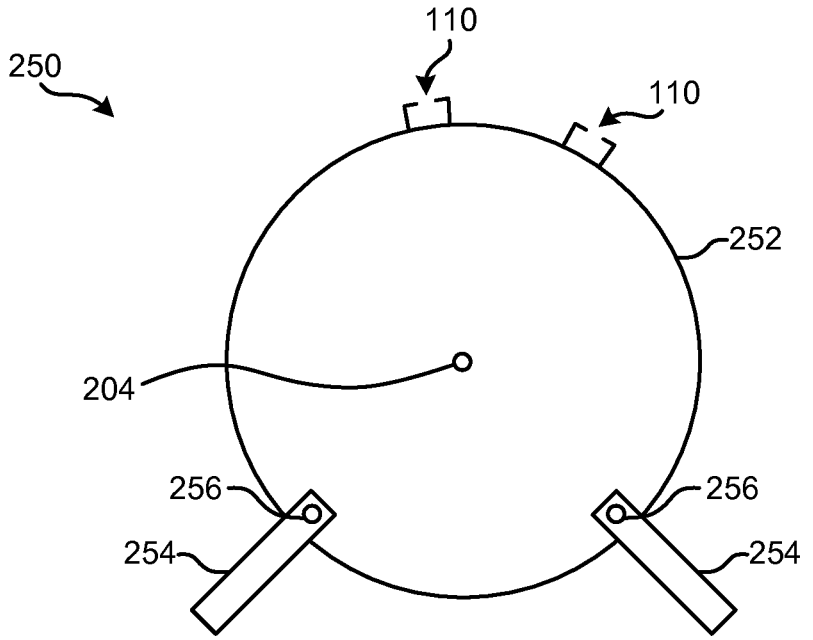
FIG. 2B is an end view of a device, in accordance with one embodiment.

The device 200 further includes channels 110 for receiving cutting strips (not shown) and leg 202 coupled to the rotational axis 204 of the device. Alternatively, as illustrated in FIG. 2B, a device 250 having a main body 252 with a circular side profile may include foldable legs 254 coupled to the main body 252 using pivotable joints 256.

Referring again to FIG. 2A, as described above, material may be pulled from inside the main body of the device and stretched over one of the cutting surfaces formed by the channels 110 and exposed cutting strips to be cut by an external cutting device.

Furthermore, due to the circular profile of the devices 200, 250, the main bodies 208, 252 may be rotated about the rotational axis 204 to achieve a desired orientation of the channels 110 and accordingly, the cutting surfaces. Moreover, once the device is positioned in a desired orientation, locking mechanisms (not shown) may be engaged to prevent further rotation of the main body, e.g., while pulling and/or cutting the material from a corresponding product stored in an interior of the main body. It follows that upon cutting a portion of the material, the locking mechanisms may be disengaged, thereby allowing the main body of the device to rotation about rotational axis 204 again.

Figure 1H:
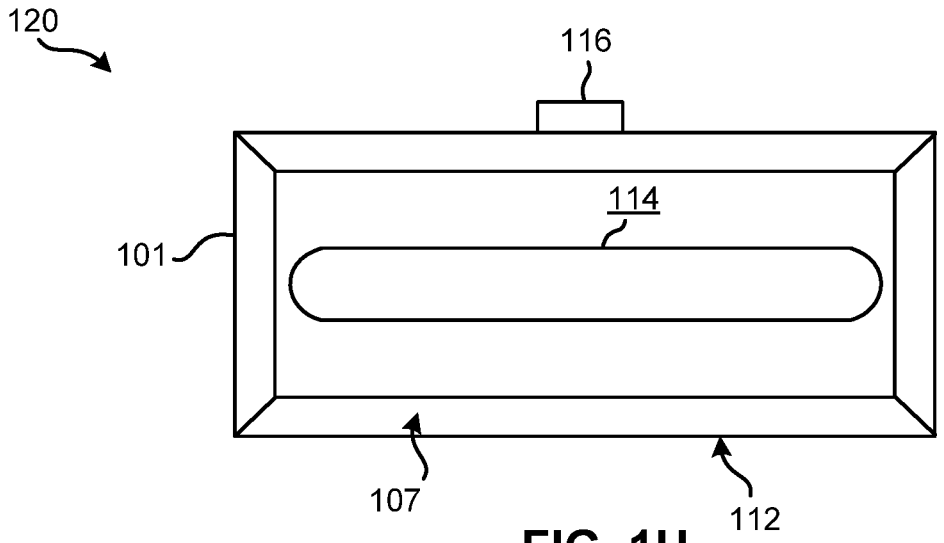
FIG. 1H is a bottom up view of a device with the bottom surface removed, according to one embodiment.

In some embodiments, a device may simply be a cap piece that is placed over the top of a product, e.g., containing and/or being a sheet of material to be cut. According to an approach, as shown in FIG. 1H, a device 120 may include a peripheral sidewall and a lid coupled to an upper edge of the peripheral sidewall. The lid and peripheral sidewall may define an interior 107 having an opening at a bottom edge 112 of the peripheral sidewall. An exemplary cap piece device may include the main body 101 of the device 100 illustrated in FIGS. 1A-1G, with the bottom surface thereof (e.g., as seen in the bottom-up view of FIG. 1G) removed.

Referring still to the present exemplary cap piece device, with the bottom surface removed, a bottom edge of the peripheral sidewall may define an opening of a recessed portion which exposes the interior of the device. Accordingly, the interior (e.g., see interior 107 above) of the device may be configured to receive a product (e.g., sheet of material) by placing the device over the top of the product as mentioned above. Thus a cap piece device may provide a desirable cutting surface for making straight cuts in the material.

According to different approaches, a cap piece device may include any of the features of any of the embodiments described above, e.g., channels, cutting strips, recessed portions, a slot, etc., or any other feature which would be apparent to one skilled in the art upon reading the present description.

A cap piece may be particularly useful in embodiments having large products, e.g., large containers, rolls and/or sheets of material, boxes, etc. Thus, rather than manufacturing, shipping, storing, etc., devices having interior areas inside the main body of the device large enough to receive said particularly large products, a cap piece device may simply be placed over the top of the particularly large products, providing similar and/or the same functionality as any of the other embodiments described herein.

Figure 4:
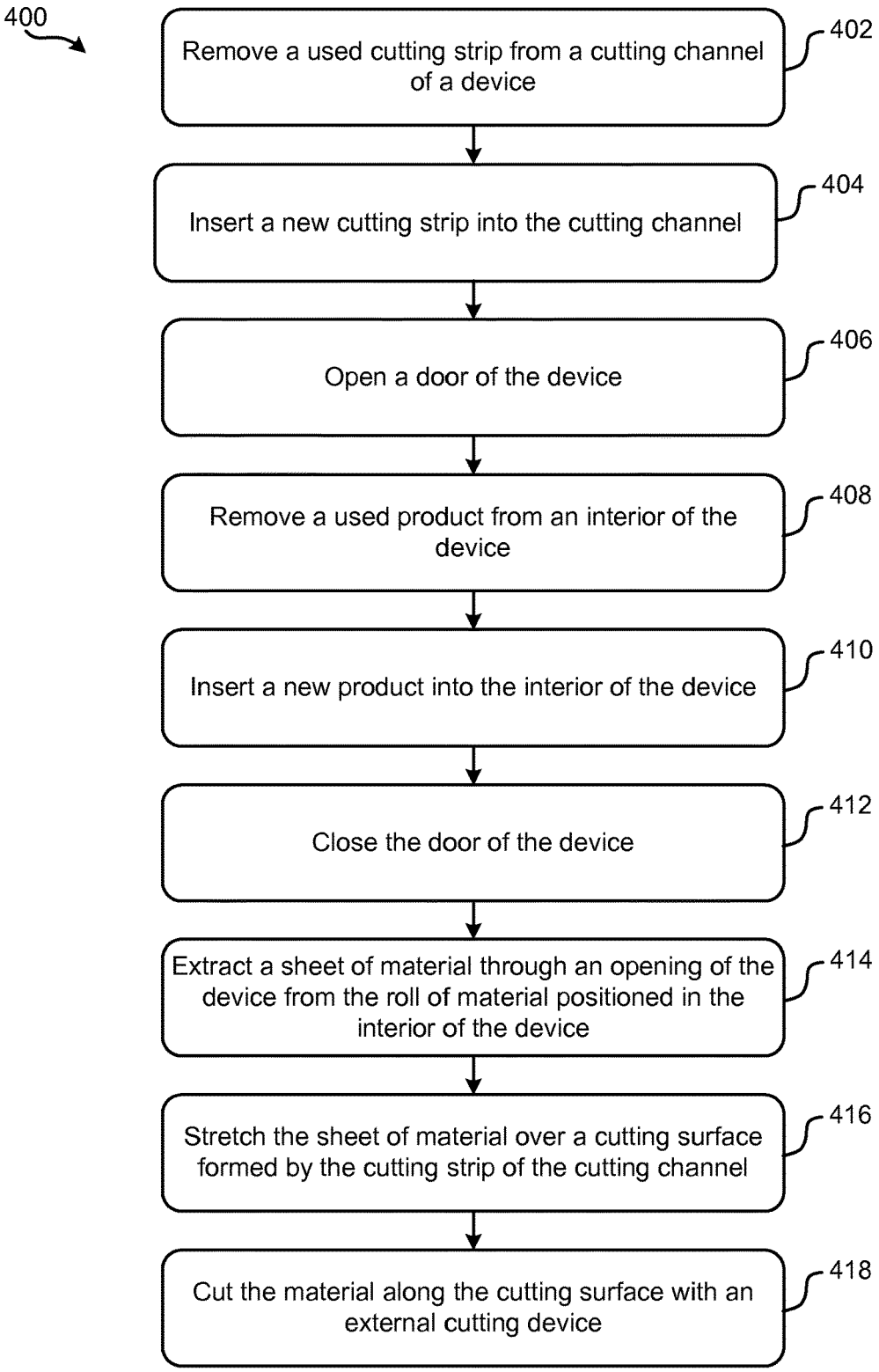
FIG. 4 is a flowchart of a method, in accordance with one embodiment.

FIG. 4 illustrates a flowchart of a method 400 for using a device as disclosed herein, in accordance with one embodiment. The method 400 may be performed in accordance with the present invention in any of the environments depicted in FIGS. 1-3B, among others, in various embodiments. Of course, more or less operations than those specifically described in FIG. 4 may be included in method 400, as would be understood by one of skill in the art upon reading the present descriptions.

Each of the steps of the method 400 may be performed by any suitable component of the operating environment. For example, in various embodiments, the method 400 may be partially or entirely performed by a controller, a processor, etc., or some other device having one or more processors therein. The processor, e.g., processing circuit(s), chip(s), and/or module(s) implemented in hardware and/or software, and preferably having at least one hardware component may be utilized in any device to perform one or more steps of the method 400. Illustrative processors include, but are not limited to, a central processing unit (CPU), an application specific integrated circuit (ASIC), a field programmable gate array (FPGA), etc., combinations thereof, or any other suitable computing device known in the art.

As shown in FIG. 4, method 400 includes removing a used cutting strip from a cutting channel. See operation 402. Moreover, operation 404 includes inserting a new (e.g., unused) cutting strip into the cutting channel.

As cutting strips are used over time, their sacrificial nature may cause the cutting strips to become weathered thereby resulting in a sub-optimal cutting surface. Accordingly, it may be desirable to remove and replace the used cutting strips after a predetermined amount of time, number of cuts, user discretion, etc., depending on the desired embodiment.

Referring still to FIG. 4, operation 406 of method 400 includes opening a door of a device (e.g., according to any of the devices described and/or suggested herein). Furthermore, operation 408 includes removing a used (e.g., empty) product from an interior of the device, while operation 410 includes inserting a new (e.g., unused) product into the interior of the device. Thereafter, the door of the device may be closed. See operation 412. As material is removed from a supply roll which may be included in the product within a device, eventually the supply of material is exhausted and a new product having a new supply of material may be used to replace the used (empty) product.

Method 400 additionally includes extracting a sheet of material through an opening of the device from the roll of material positioned in the interior of the device. See operation 414. Furthermore, operation 416 includes stretching the sheet of material over a cutting surface formed by the cutting strip of the cutting channel. Thereafter, the material may be cut along the cutting surface with an external cutting device. See operation 418. Again, the exemplary embodiment in FIGS. 1A-1F of U.S. Provisional Patent Application No. 61/971,423, which is incorporated by reference, illustrates a process of inserting a product into the device and cutting a desired amount of material extracted from the product using cutting surfaces formed by cutting strips positioned in the cutting channels, any aspect of which may be implemented in conjunction with any one or more of the operations of method 400 above.

It should also be noted that for any of the embodiments described herein, a roll of material may be removed from its corresponding box before being inserted into a device. Moreover, some devices, e.g., those devices having circular or rounded side profiles, may be designed and/or constructed for receiving only a roll of material.

Additional exemplary embodiments are also presented below. Looking to the supplementary images attached, any of the corresponding features depicted therein may be implemented in conjunction with features from any other embodiment listed herein, such as those described with reference to the other FIGS. Of course, however, such attached supplementary images may be used in various applications and/or in permutations which may or may not be specifically described in the illustrative embodiments listed herein. Further, the attached supplementary images presented below may be used in any desired environment. Thus the attached supplementary images (and the other FIGS.) should be deemed to include any and all possible permutations.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A device, comprising: a sidewall defining an interior;

at least two cutting channels, wherein each cutting channel has, and/or is configured to receive a cutting strip, wherein a first cutting strip extends along a length of a first of the cutting channels and a second cutting strip extends along a length of a second of the cutting channels, wherein no integrated cutting device is coupled to the device;

an opening in the sidewall configured to allow a sheet of material to pass therethrough from the interior, wherein the length of each cutting channel extends along and parallel to an entire length of the opening; and a door coupled to the sidewall, wherein the sidewall includes a top having the opening, a bottom, and a peripheral sidewall extending between the top and the bottom, wherein the door in a closed position secures the cutting strip in the associated cutting channel.

2. The device of claim 1, comprising the first cutting strip positioned in the first of the cutting channels and a second cutting strip positioned in a second of the cutting channels, each first and second cutting strip forming a cutting surface.

3. The device of claim 1, wherein at least one of the cutting channels is positioned relative to the opening to receive the sheet of material directly over the cutting channel in a stretched flat form.

4. The device of claim 1, wherein at least one end of each of the cutting channels has a recessed portion for allowing an external cutting device to move past the end of the cutting strip in the cutting channel, wherein the cutting channels extend along an entire length of the sidewall between each end of the sidewall.

5. The device of claim 1, comprising a retractable hanger coupled to the sidewall.

6. The device of claim 1, comprising fold-out legs coupled to the sidewall.

7. The device of claim 1, comprising:

the cutting strip in each cutting channel, each cutting strip forming a unique cutting surface, wherein each cutting channel is coupled to the sidewall, wherein each cutting channel protrudes above the sidewall, wherein each cutting channel is rigid;

wherein the door opens along an arc that is parallel to the top portion of the sidewall;

fold-out legs coupled to the sidewall;

a handle coupled to the peripheral sidewall; and wherein each cutting strip is removable from the associated cutting channel, wherein each cutting strip is comprised of a sacrificial material, wherein at least one end of each cutting channel has a recessed portion for allowing an external cutting device to move past least-one end of the cutting strip in the associated cutting channel, wherein each cutting channel extends along an entire length of the sidewall between each end of the sidewall, wherein the door has a recessed portion, wherein the recessed portion of the door in the closed position is aligned with the cutting channel for allowing the external cutting device to move past the end of the cutting strip in each cutting channel, wherein no integrated cutting device is coupled to the device, wherein at least one of the cutting channels is positioned relative to the opening to receive the sheet of material directly over the cutting channel in a stretched flat form.

8. A device comprising: a sidewall defining an interior;

at least two cutting channels, wherein each cutting channel has, and/or is configured to receive a cutting strip, wherein a first cutting strip extends along a length of a first of the cutting channels and a second cutting strip extends along a length of a second of the cutting channels;

an opening in the sidewall configured to allow a sheet of material to pass therethrough from the interior, wherein the length of each cutting channel extends along and parallel to an entire length of the opening;

the cutting strip in each cutting channel, each cutting strip forming a unique cutting surface, wherein each cutting channel is coupled to the sidewall, wherein each cutting channel protrudes above the sidewall, wherein each cutting channel is rigid; and a door coupled to the sidewall, wherein the sidewall includes a top having the opening, a bottom, and a peripheral sidewall extending between the top and the bottom, wherein the door in a closed position secures the cutting strip in the associated cutting channel, wherein the door opens along an arc that is parallel to the top portion of the sidewall, wherein each cutting strip is removable from the associated cutting channel, wherein each cutting strip is comprised of a sacrificial material, wherein at least one end of each cutting channel has a recessed portion for allowing an external cutting device to move past at least-one end of the cutting strip in the associated cutting channel, wherein each cutting channel extends along an entire length of the sidewall between each end of the sidewall, wherein the door has a recessed portion, wherein the recessed portion of the door in the closed position is aligned with the cutting channel for allowing the external cutting device to move past the end of the cutting strip in each cutting channel, wherein no integrated cutting device is coupled to the device, wherein at least one of the cutting channels is positioned relative to the opening to receive the sheet of material directly over the cutting channel in a stretched flat form.

* * * * *